US008038852B2

(12) United States Patent
Tojo et al.

(10) Patent No.: US 8,038,852 B2
(45) **Date of Patent: *Oct. 18, 2011**

(54) FLUORINE GAS GENERATOR

(75) Inventors: Tetsuro Tojo, Osaka (JP); Jiro Hiraiwa, Osaka (JP); Osamu Yoshimoto, Osaka (JP); Hitoshi Takebayashi, Osaka (JP); Yoshitomi Tada, Osaka (JP); Udai Tanaka, Osaka (JP)

(73) Assignee: Toyo Tanso Co., Ltd., Osaka (JP)

( * ) Notice: Subject to any disclaimer, the term of this patent is extended or adjusted under 35 U.S.C. 154(b) by 380 days.

This patent is subject to a terminal disclaimer.

(21) Appl. No.: 10/447,237

(22) Filed: May 29, 2003

(65) Prior Publication Data

US 2004/0007457 A1 Jan. 15, 2004

(30) Foreign Application Priority Data

May 29, 2002 (JP) ..... 2002-155097

(51) Int. Cl.
*C25B 9/00* (2006.01)
*C25B 1/24* (2006.01)

(52) U.S. Cl. ..... 204/228.2; 204/228.1; 204/228.4; 204/245; 204/246; 204/247; 204/275.1; 204/277; 204/278; 205/411

(58) Field of Classification Search ..... 204/245–247, 204/243.1, 275.1, 228.2, 228.4, 228.5, 228.1, 204/277–278; 205/618–619, 637, 498, 411
See application file for complete search history.

(56) References Cited

U.S. PATENT DOCUMENTS

| | | | | |
|---|---|---|---|---|
| 4,172,773 | A * | 10/1979 | Pellegri et al. | 205/743 |
| 4,179,371 | A * | 12/1979 | Foreman et al. | 406/50 |
| 4,382,382 | A * | 5/1983 | Wang | 73/304 R |
| 6,818,105 | B2 * | 11/2004 | Tojo et al. | 204/240 |

FOREIGN PATENT DOCUMENTS

| | | | |
|---|---|---|---|
| EP | 1283280 | A1 | 12/2003 |
| JP | 02-232386 | | 9/1990 |
| JP | 2000-112100 | | 4/2000 |
| JP | 2001-009443 | | 1/2001 |
| WO | WO 96/08589 | | 3/1996 |
| WO | WO01/77412 | * | 10/2001 |
| WO | WO 01/77412 | | 10/2001 |

* cited by examiner

*Primary Examiner* — Roy King
*Assistant Examiner* — Lois Zheng
(74) *Attorney, Agent, or Firm* — Oblon, Spivak, McClelland, Maier & Neustadt, L.L.P.

(57) ABSTRACT

A fluorine gas generator for generating highly pure fluorine gas in a stable and safe manner by electrolyzing an electrolytic bath 2 comprising hydrogen fluoride in the form of a molten mixed gas is provided which comprises an electrolytic cell 1 divided, by a partition wall 16, into an anode chamber 3 in which an anode is disposed and a cathode chamber 4 in which a cathode is disposed, pressure maintenance means for maintaining the anode chamber 3 and cathode chamber 4 at atmospheric pressure, and liquid level sensing means 5, 6 capable of sensing the levels of the electrolytic bath 2 in the anode chamber 3 and in the cathode chamber 4, respectively, at three or more level stages.

14 Claims, 3 Drawing Sheets

FLUORINE GAS GENERATOR

BACKGROUND OF THE INVENTION

1. Field of the Invention

The present invention relates to an on-site type fluorine gas generator.

2. Description of the Prior Art

Fluorine gas is one of the key gases essential in the field of semiconductor production, for instance. While it is used as such in certain instances, the demand for nitrogen trifluoride gas (hereinafter referred to as "$NF_3$ gas") and like gases synthesized based on fluorine gas and intended for use as cleaning gases or dry etching gases in semiconductor manufacturing apparatus has been rapidly increasing. Further, neon fluoride gas (hereinafter referred to as "NeF gas"), argon fluoride gas (hereinafter referred to as "ArF gas"), krypton fluoride gas (hereinafter referred to as "KrF gas") and the like are excimer laser oscillation gases used in patterning of integrated semiconductor circuits, and the raw materials thereof used in many cases are mixed gases composed of a rare gas and gaseous fluorine.

The fluorine gas or $NF_3$ gas for use in the manufacture of semiconductors and the like is required to be highly pure with the impurity content as low as possible. On the sites of semiconductor manufacture, for instance, necessary amounts of fluorine gas are taken out of gas cylinders filled with nitrogen gas. It thus becomes very important to secure sites for storing such cylinders, store the gas safely, maintain the purity of the gas, and manage for such purposes. As for $NF_3$ gas, for which the demand has been increasing lately, the demand tends to exceed the supply, hence there arises a problem that certain amounts of the gas should be in stock. In view of these, to have a fluorine gas generator or producer of the on-demand and on-site type at the site of use thereof is preferred to handling high-pressure fluorine gas cylinders.

Conventionally, fluorine gas is produced in a electrolytic cell such as shown in FIG. 3. The electrolytic cell body 201 is generally made of Ni, Monel, carbon steel or the like. At the bottom of the electrolytic cell body 201, a bottom plate 212 made of polytetrafluoroethylene or the like is disposed for preventing the hydrogen gas and fluorine gas generated from being mixed with each other. The electrolytic cell body 201 is filled with an electrolytic bath 202, namely a potassium fluoride-hydrogen fluoride system (hereinafter referred to as "KF-HF system") in the form of a mixed molten salt. The cell or bath is divided into an anode chamber 210 and a cathode chamber 211 by means of a skirt 209 made of Monel or the like. Upon applying a voltage between a carbon or nickel (hereinafter referred to as "Ni") anode 203 contained in the anode chamber and a Ni cathode 204 contained in the cathode chamber 211, electrolysis occurs and fluorine gas is produced. The fluorine gas generated is discharged through a product line 208, and the hydrogen gas formed on the cathode side is discharged through a hydrogen gas discharge line 207. There is a problem, however. Contamination by carbon tetrafluoride (hereinafter referred to as "$CF_4$ gas") generated simultaneously upon electrolysis and hydrogen fluoride gas (hereinafter referred to as "HF gas") evaporating from the electrolytic bath, among others, makes it difficult to obtain highly pure fluorine gas.

For on-demand and on-site operation, automatic control of the electrolytic bath level in the electrolytic cell body 201 is indispensable to the safety in automatic operation. As regards the technology of controlling the fluctuation in electrolyte level, for instance, Laid-open Japanese Patent Application (JP Kohyo) H09-505853 corresponding to FP0728228B1, EP0852267B1, EP0965661B1 and U.S. Pat. No. 5,688,384 proposes the so-called start/stop (on/off) control. However, when electrolysis is carried out using this technology, there arises a problem. Namely, the electrolysis is interrupted upon occurrence of a certain extent of fluctuation in liquid level, and the electrolysis cannot be restarted until the electrolyte level returns to the original level.

Accordingly, it is an object of the present invention to provide a fluorine gas generator capable of generating highly pure fluorine gas stably and safely.

SUMMARY OF THE INVENTION

The above object is accomplished by providing, in accordance with the present invention, a fluorine gas generator for generating highly pure fluorine gas by electrolyzing an electrolytic bath comprising hydrogen fluoride in the form of a molten mixed salt which generator comprises, according to Claim 1, an electrolytic cell divided, by a partition wall, into an anode chamber in which an anode is disposed and a cathode chamber in which a cathode is disposed, pressure maintenance means for maintaining the electrolytic cell inside at atmospheric pressure, and liquid level sensing means capable of sensing the levels of the electrolytic bath in the anode chamber and in the cathode chamber, respectively, at three or more level stages.

According to this constitution, slight fluctuations in liquid level can be detected, and the anode chamber inside and cathode chamber inside can be maintained at atmospheric pressure by means of the pressure maintenance means. As a result, the level of the electrolytic bath as a whole is stabilized. Thus, the fluctuations in electrolytic conditions during electrolysis can be reduced, and stable supply of fluorine gas becomes possible. Further, since the anode chamber inside and cathode chamber inside are maintained at atmospheric pressure, air or the like can be prevented from flowing thereinto from the outside, so that highly pure fluorine gas can be generated in a stable manner.

In an embodiment according to Claim 2, the pressure maintenance means in the fluorine gas generator according to Claim 1 comprises automatic valves operated (opened/closed) in association with pressure gauges connected to the anode chamber and cathode chamber, respectively, and automatic valves operated in association with the level sensing means disposed in the anode chamber and cathode chamber, respectively.

This constitution makes it possible to control the electrolytic cell inside pressure in an easy and reliable manner. The operation of the automatic valves in association with the level sensing means makes it possible to automatically control the level of the electrolytic bath.

In an embodiment according to Claim 3, the automatic valves, which are one of the constituent elements of the pressure maintenance means for maintaining the electrolytic cell inside pressure at atmospheric pressure in the fluorine gas generator according to Claim 2, are opened to discharge the electrolytic cell inside gas when the electrolytic cell inside pressure becomes higher than atmospheric pressure.

This constitution makes it possible to maintain the electrolytic cell inside, in particular the cathode chamber inside, always at atmospheric pressure. As a result, the level of the electrolytic bath in the electrolytic cell can be always maintained in a stable condition.

In an embodiment according to Claim 4, a compressor and/or a vacuum generator is disposed behind the automatic valves operated in association with the pressure gauges in the fluorine gas generator according to any one of Claims 1 to 3 to maintain the valves operated in association with the pressure gauges in a reduced pressure state.

According to this constitution, the gas discharge lines on the downstream side of the automatic valves operated in association with the pressure gauges are placed in a reduced pressure state. Thus, the gas discharged from the cathode chamber passes through the valve operated in association with the relevant pressure gauge in a more reliable manner.

In an embodiment according to Claim 5, the level sensing means in the fluorine gas generator according to Claim 1 each comprises at least three level sensors capable of sensing different liquid levels of the electrolytic bath.

This constitution makes it possible to detect the electrolytic bath liquid levels in the electrolytic cell at three or more stages and, therefore, detect even small changes in liquid level. And, it becomes possible to operate each valve on each gas line connected with the electrolytic cell in response to the signal from the relevant level sensor to allow gas inflow for pressurization or reduce the pressure to raise the liquid level. Therefore, automatic operation becomes possible while maintaining each liquid level at a constant level without discontinuation of electrolysis as resulting from electrolytic bath level control (on/off control), as described in JP Kohyo H09-505853, EP0728228B1, EP0852267B1, EP0965661B1, and U.S. Pat. No. 5,688,384.

In an embodiment according to Claim 6, the fluorine gas generator has pressure gages capable of detecting the electrolytic cell inside pressures in addition to the level sensing means.

This constitution makes it possible to more precisely control the liquid level fluctuations due to the differential pressure-caused ascending or descending of the electrolytic bath and prevent the choking of filters or the like disposed in the downstream piping and lines due to splashing of the electrolytic bath, for instance. This control makes it possible to ensure the operation in a safe and stable manner.

In an embodiment according to Claim 7, a rare gas or nitrogen gas is fed to the cathode chamber or/and anode chamber through the automatic valves operated in association with the level sensing means in the fluorine gas generator according to Claim 1 or 2.

According to this constitution, the gas generated, when diluted with a rare gas such as neon gas (Ne gas), argon gas (Ar gas) or krypton gas (Kr gas), can be used, in the form of a mixed gas with an arbitrary mixing ratio, as the excimer laser oscillation gas in patterning integrated semiconductor circuits.

Figure 1:
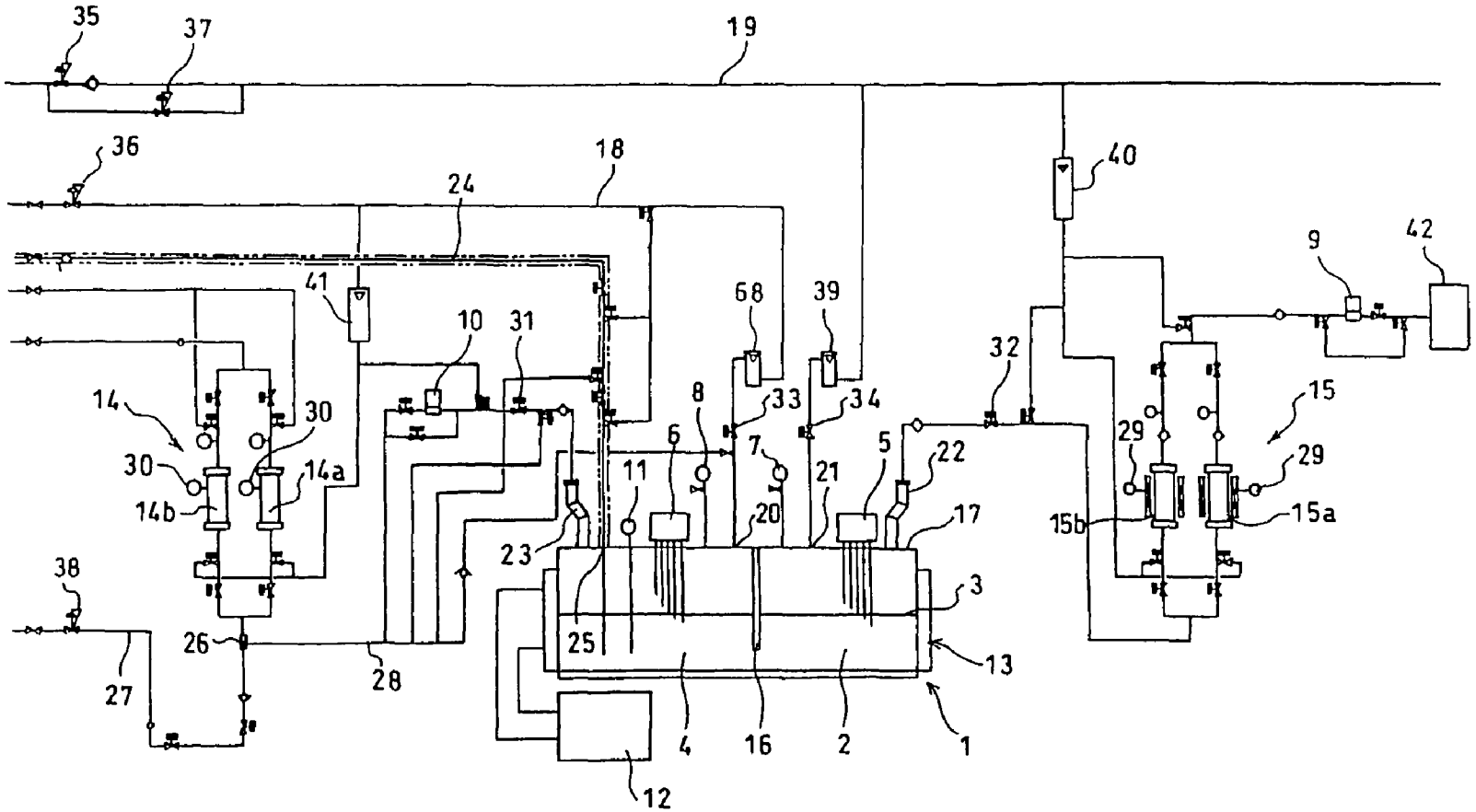
FIG. 1 is a schematic representation of the principal part of the fluorine gas generator according to the invention.
Figure 2:
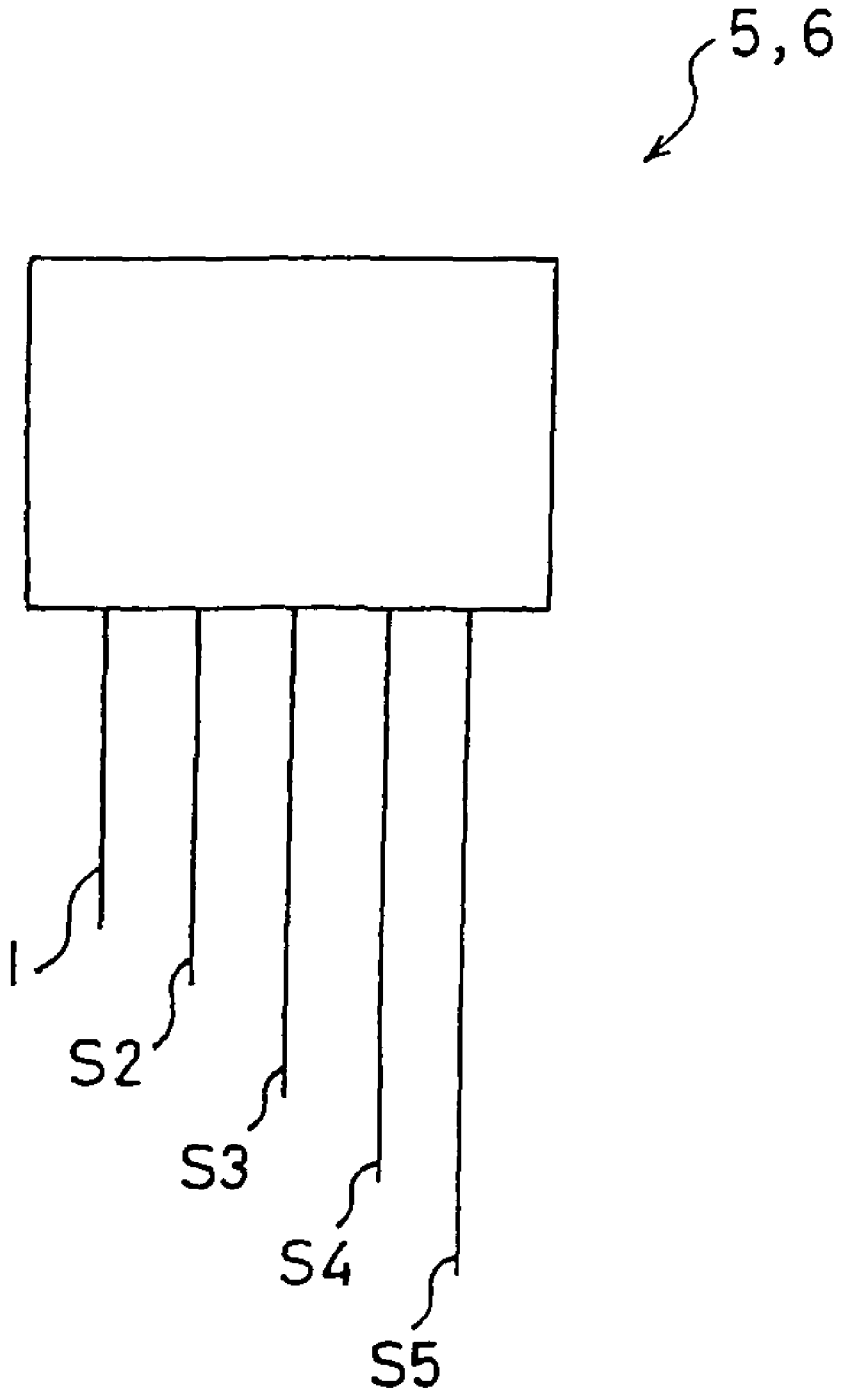
FIG. 2 is a schematic representation of an example of the liquid level sensing means used in the fluorine gas generator according to the invention.
Figure 3:
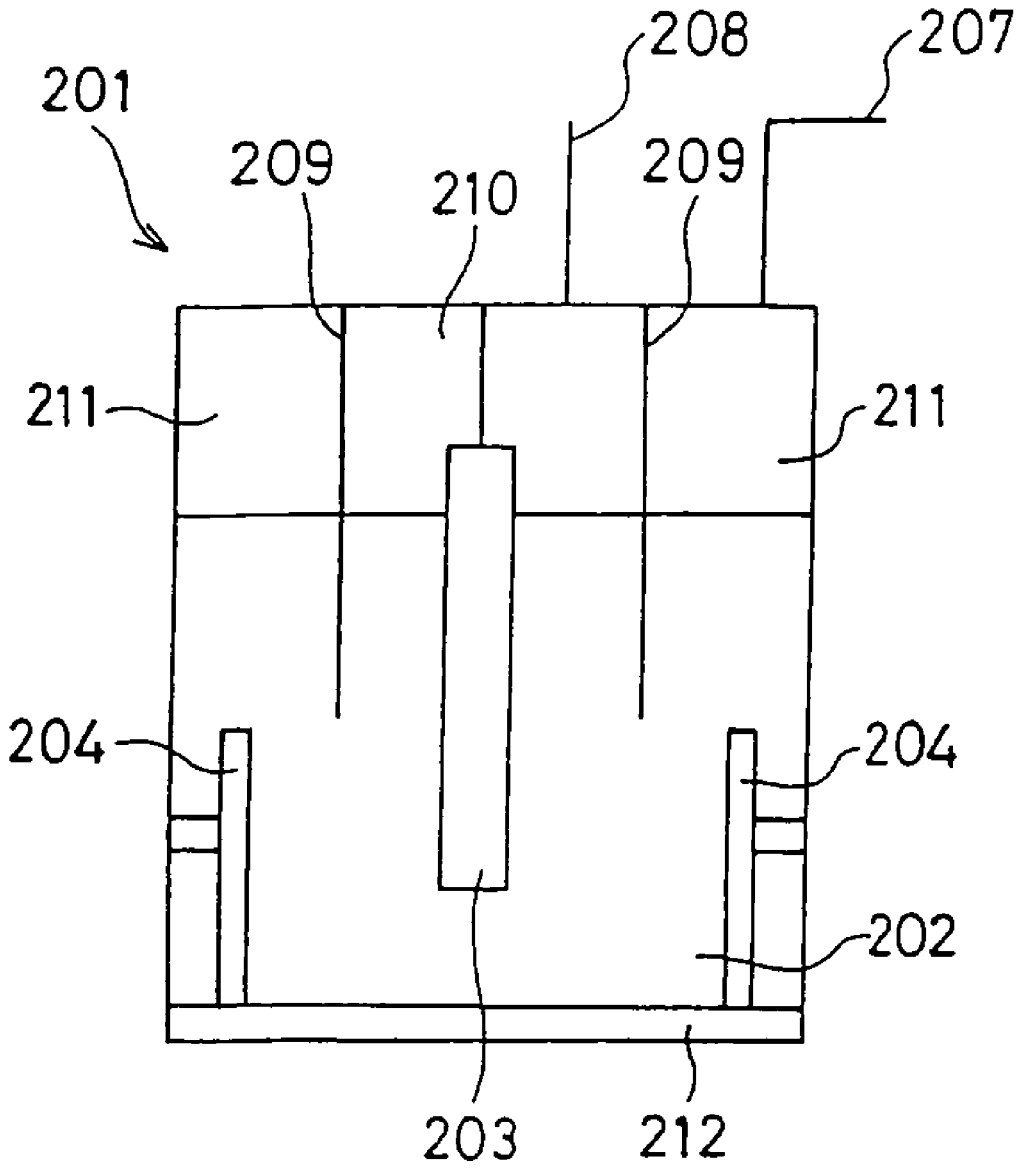
FIG. 3 is a schematic representation of a fluorine gas generator conventional in the art.

In the figures, 1 stands for an electrolytic cell, 2 for an electrolytic bath, 3 for an anode chamber, 4 for a cathode chamber, 5 for first level sensing means, 6 for second level sensing means, 7 and 8 each for a pressure gauge, 9 and 10 each for an automatic valve, 11 for a thermometer, 12 for temperature control means, 13 for a heater, 14 for an HF adsorber, 15 for an HF absorber, 16 for a partition wall, 17 for an upper covering, 18 and 19 each for a gas line, 20, 21 each for a purge gas inlet/outlet, 22 and 23 each for a gas outlet port, 24 for an HF feed line, 25 for an HF introduction port, 26 for a vacuum generator, 27 and 28 each for a gas line, 29 and 30 each for a pressure gauge, 31 to 34 each for an automatic valve, 35 to 38 each for a manual valve, 39 to 41 each for a flowmeter, 42 for a compressor unit, and S1 to S5 each for a level sensor.

DETAILED DESCRIPTION OF THE PREFERRED EMBODIMENTS

Now, referring to the drawings, an example of the fluorine gas generator according to the invention is described.

FIG. 1 is a schematic representation of the principal part of a fluorine gas generator according to the invention. In FIG. 1, 1 is an electrolytic cell, 2 is an electrolytic bath consisting of a fused or molten KF-HF system-based salt, 3 is an anode chamber, 4 is a cathode chamber, 5 is first level sensing means for sensing the level of the electrolytic bath 2 in the anode chamber 3, 6 is second level sensing means for sensing the liquid level in the cathode chamber 4 at 5 level stages. Further, 7 is a pressure gauge for measuring the pressure in the anode chamber, and 8 is a pressure gauge for measuring the pressure in the cathode chamber 4. 9 and 10 are automatic valves operated in association with the pressures measured by the pressure gauges 7 and 8. 11 is a thermometer for measuring the temperature of the electrolytic bath 2, and 12 is temperature control means for controlling a heater 13 disposed around the side faces and bottom of the electrolytic cell 1 according to the signals from the thermometer 11. 14 is an adsorber for adsorbing HF gas in the hydrogen-HF mixed gas discharged from the cathode chamber 4, and 15 is an HF absorber packed with NaF, for instance, for adsorbing HF gas in the $F_2$-HF mixed gas discharged from the anode chamber 3 to thereby discharge highly pure fluorine gas alone.

The electrolytic cell 1 is made of a metal such as Ni, Monel, pure iron or stainless steel. The electrolytic cell 1 is divided into the anode chamber 3 and cathode chamber 4 by means of a partition wall 16 made of Ni or Monel. Within the anode chamber 3, there is disposed an anode (not shown). In the cathode chamber 4, there is disposed a cathode (not shown). The anode is preferably a block-shaped one prepared from a graphite molding by processing to an appropriate shape. The cathode is preferably made of Ni or iron. The upper covering 17 of the electrolytic cell 1 has inlets/outlets 20, 21 for a purge gas from gas lines 18, 19, which are constituent elements of the pressure maintenance means for maintaining the anode chamber 3 inside and cathode chamber 4 inside at atmospheric pressure, an outlet port 22 for the fluorine gas generated in the anode chamber 3, and an outlet port 23 for the hydrogen gas generated in the cathode chamber 4. These outlet ports 22, 23 each comprises a bent pipe made of an anticorrosive material resistant to fluorine gas, such as Hastelloy, for preventing splashes from the anode chamber 3 and cathode chamber 4 from entering the gas lines. The upper covering 17 is also provided with an inlet 25 for introducing HF from an HF feeding line 24 when the level of the electrolytic bath 2 descends, first level sensing means 5, second level sensing means 6 for sensing the levels in the anode chamber 3 and cathode chamber 4, respectively, and pressure gauges 7 and 8.

The electrolytic cell 1 is further provided with temperature adjusting means for heating the inside of the electrolytic cell 1. The temperature adjusting means is constituted of the heater 13 disposed around the electrolytic cell 1 in close contact therewith, temperature control means 12 connected with the heater 13 and capable of conventional PID control, and a thermometer 11, for example a thermocouple, disposed in either one of the anode chamber 3 and cathode chamber 4, and thus controls the temperature in the electrolytic cell 1. It is also possible to dispose a heat insulating material around the heater 13. The heater 13 may be of the ribbon type, nichrome wire type, or warm water type, for instance. The shape is not particularly restricted but preferably is such that the electrolytic cell is wholly surrounded.

The first level sensing means 5 and second level sensing means 6 each is provided, for example, with five level sensors S1 to S5. The liquid level height of the electrolytic bath 2 can be detected stepwise by means of these five sensors S1 to S5.

The pressure maintenance means for maintaining the inside of the anode chamber 3 and cathode chamber 4 at atmospheric pressure comprises automatic valves 9, 10 operated for passing or shutting a pressurizing gas from a gas cylinder in according to the results of pressure gauges 7, 8 for measuring the pressures in the anode chamber 3 and cathode chamber 4, respectively, automatic valves 31-34 operated according to the results of sensing of the liquid levels of the electrolytic bath 2 by the first level sensing means 5 and second level sensing means 6 to feed or discharge the gas to or from the anode chamber 3 or/and cathode chamber 4, respectively, manual valves 35-38 operated for passing or shutting the gas lines 18, 19, etc. of this pressure maintenance means, and flowmeters 39-41 capable of adjusting the gas flow rates in the gas lines to respective appropriate rates previously. The automatic valves 31-34 are preferably of the air actuator type so that the heat generation at the time of operation can be reduced and the effects on the gas lines can be reduced. This pressure maintenance means maintains the pressure in the anode chamber 3 and cathode chamber 4 at the atmospheric pressure level, whereby the pressure in the electrolytic cell 1 is maintained at the atmospheric pressure level and the level heights can be maintained in a stable condition during electrolysis. Therefore, the fluctuations in electrolysis conditions are small, hence the electrolysis can be carried out stably. The fluorine gas and hydrogen gas formed upon electrolysis are discharged, in a forced-out manner, from the electrolytic cell 1 through the outlets 22, 23. Thus, the pressure maintenance means maintains the anode chamber 3 inside and cathode chamber 4 inside at atmospheric pressure and thereby discharges the gases generated upon electrolysis from the electrolytic cell 1 and, at the same time, prevents the open air from coming into the electrolytic cell 1.

The gas to be fed to the electrolytic cell 1 connected with the pressure maintenance means is not particularly restricted but may be any inert gas. When, for example, nitrogen gas or at least one of rare gases such as Ar gas, Ne gas, Kr gas and Xe gas is used, a mixed gas composed fluorine gas and such a rare gas can be easily obtained in an arbitrary mixing ratio. In this way, it becomes possible to use the mixed gas, for example, as a radiation source for excimer laser oscillation in patterning integrated circuits in the field of semiconductor manufacture. By disposing the fluorine gas generator of the invention on a production line in the field of semiconductor manufacture, it becomes possible to feed fluorine gas on site in case of necessity in an amount required.

The HF adsorber 14 for adsorbing HF gas in the hydrogen gas discharged from the cathode chamber 4 comprises a first adsorption column 14*a* and a second adsorption column 14*b* disposed in parallel. These first adsorption column 14*a* and second absorption column 14*b* may be operated simultaneously, or one of them alone may be operated. This adsorber 14 is preferably made of an anticorrosive material resistant to fluorine gas and HF, for example stainless steel, Monel, Ni, or a fluororesin. The inside thereof is filled with sodium fluoride or soda lime, for instance, which adsorbs HF passing therethrough and thereby eliminating HF from the hydrogen gas.

This HF adsorber 14 is disposed on the downstream side of the automatic valve 10, which is one of the constituent elements of the pressure maintenance means. A vacuum generator 26 is disposed between this automatic valve 10 and the HF adsorber 14. This vacuum generator 26 serves to place the inside of the gas line 28 in a reduced pressure condition utilizing the ejector effect of the gas passing through the gas line 27. Thus, the gas line 28 can be placed in a reduced pressure state without using any oil, hence oil invasion into the gas line and electrolytic cell 1 can be avoided.

Like the above-mentioned HF adsorber 14, the HF absorber 15 for removing HF in the fluorine gas discharged from the anode chamber 3 comprises a first absorption column 15*a* and a second absorption column 15*b* disposed in parallel. NaF is filled in the inside of each column and removes HF contained in the fluorine gas discharged. Like the HF adsorber 14, this HF absorber 15 is preferably made of an anticorrosive material resistant to fluorine gas and HF, for example stainless steel, Monel or Ni.

On the downstream side of this HF absorber 15, there is disposed the automatic valve 9, which is one the constituent elements of the pressure maintenance means. The gas generated from the anode chamber 3 is in a server environment where HF gas is formed simultaneously with fluorine gas and splashing of the electrolytic bath occurs. Particularly, in an environment where fluorine and HF occur in a mixed state, a strongly oxidative atmosphere is created. When the automatic valve is disposed on the downstream side of the HF absorber 15, a condition in which HF-free fluorine gas alone occurs can be created and the valve can be operated without being affected by HF gas. The HF adsorber 14 and HF absorber 15 are provided with pressure gauges 30 and 29, respectively, whereby the choking in the inside can be detected upon occurrence thereof.

The fluorine gas generator comprising such electrolytic cell 1 is preferably set up within a cabinet formed of one box body (not shown). This is because the on-demand, on-site use of the generator is facilitated thereby. The cabinet is preferably made of a material nonreactive with fluorine gas, for example such as metal as stainless steel or such a resin as polyvinyl chloride.

Though not shown in FIG. 1, storage means, for example a buffer tank, is preferably disposed downstream from the side of high purity fluorine gas discharge. This makes it possible to supply fluorine gas at any time in case of necessity and in any required amount. According to this arrangement, a fluorine gas generator for the manufacture lines on the sites of semiconductor manufacture is provided.

The operation of such fluorine gas generator according to the above-mentioned embodiment of the invention is now described.

While electrolysis is proceeding smoothly, the inside of the electrolytic cell 1 is generally maintained at atmospheric pressure and the level of the electrolytic bath 2 in the anode chamber 3 is equal to that in the cathode chamber 4. However, when the fluorine gas line (gas line behind the fluorine gas outlet 22) or the hydrogen gas line (gas line behind the hydrogen outlet 23) is choked by accumulated splashes of the electrolytic bath 2, for instance, the pressure within the electrolytic cell 1 fluctuates. On such occasion, the pressure gauges 7, 8 connected to the anode chamber 3 and cathode chamber 4, respectively, measure the pressures and, according to the pressure fluctuations, the automatic valves 9, 10 are operated in association with the pressure gauges 7, 8 to make adjustments so that the pressure within the electrolytic cell 1 may be maintained at the atmospheric pressure level.

While the inside of the electrolytic cell 1 is maintained at atmospheric pressure by the operation of the automatic valves 9, 10 in that manner, the level height of the electrolytic bath 2 in the anode chamber 3 and that in the cathode chamber 4 in the electrolytic cell 1 become equal to each other. In certain instances, however, further accumulation of splashes of the electrolytic bath 2, for instance, makes it impossible for the operation alone of the automatic valves to maintain the inside of the electrolytic cell 1 at atmospheric pressure, for example the pressure in the anode chamber 3 increases due to choking of the fluorine gas line (gas line behind the fluorine gas outlet 22), for instance, or the pressure in the cathode chamber 4 decreases, with the result that the level height of the electrolytic bath 2 in the anode chamber 3 becomes lower than that in the cathode chamber 4. In this case, the abnormality in liquid level is detected by the first level sensing means 5 and second level sensing means 6 disposed in the anode chamber 3 and cathode chamber 4.

While electrolysis is proceeding normally and the inside of the electrolytic cell 1 is maintained at atmospheric pressure by the operation of the automatic valves 9, 10, the liquid level height of the electrolytic bath 2 is generally located at a position between the level sensors S2 and S4 among the five level sensors S1 to S5 in each of the first level sensing means 5 and second level sensing means 6. When, however, the level height of the electrolytic bath 2 in the cathode chamber 4 becomes higher than that in the anode chamber 3, as mentioned above, namely when the liquid level becomes higher than the level sensor 2 of the second level sensing means, the automatic valve 31 and automatic valve 34 are closed. When the level of the electrolytic bath 2 in the cathode chamber 4 returns to a normal level as a result of such operation, the automatic valve 31 and automatic valve 34 are opened and electrolysis is continued. If the level of the electrolytic bath 2 in the cathode chamber 2 still increases even after closure of the automatic valve 31 and automatic valve 34 and exceeds the level of the level sensor S1, the automatic valve 33 and automatic valve 32 are also closed and the electrolysis is discontinued.

Upon discontinuation of electrolysis, the automatic valve 32 is opened for a short period of time, and the fluorine gas in the anode chamber 3 is discharged through the fluorine gas outlet 23 on the upper covering 17 of the electrolytic cell 1. At the same time, the automatic valve 33 is also opened for a short period and a purge gas is introduced into the cathode chamber 4. When the level heights of the electrolytic bath 2 in the anode chamber 3 and that in the cathode chamber 4 become equal again, electrolysis is restarted.

In the fluorine gas generator according to the above embodiment, the pressure within the electrolytic cell is adjusted by means of the pressure gages 7, 8 for measuring the pressures within the electrolytic cell 1 inside and the automatic valves 9, 10 operated in association with those gauges, and the level height of the electrolytic bath 2 is controlled while maintaining the electrolytic cell 1 inside at atmospheric pressure, as described hereinabove. In cases where the level heights of the electrolytic bath 2 in the electrolytic cell 1 cannot be maintained at the same level by the operation of those automatic valves 9, 10, the inside of the electrolytic cell 1 is maintained at atmospheric pressure by means of the first level sensing means 5 and second level sensing means 6 disposed in the anode chamber 3 and cathode chamber 4, respectively, and the automatic valves 31-34 operated in association with those means. Such a two-stage control system makes it possible to maintain the level height of the electrolytic bath 2 at a stabilized level. Thus, stable fluorine gas formation can be realized without need of modifying the electrolysis conditions during electrolysis.

The fluorine gas generator according to the invention is not limited to the embodiment described above but may include the following modifications, for instance.

Thus, for example, the electrolytic cell itself may be utilized as the cathode in electrolyzing the electrolytic bath and, on that occasion, only one level sensing means may be used to sense the level height of the electrolytic bath for electrolytic bath level control. The positions and number of the automatic valves are not limited to those employed in the embodiment described above, either.

In accordance with the present invention, which has the constitution described above, the electrolytic cell inside is maintained at atmospheric pressure and the level heights of the electrolytic bath are sensed and controlled by means to two systems, namely the pressure gauges and level sensing means. As a result, it becomes possible to maintain the electrolytic bath level height at a constant level, stabilize the electrolysis conditions, and generate and supply fluorine gas stably. In addition, the provision of means for mixing fluorine gas with another gas, for example a rare gas, makes it possible to obtain a mixed gas composed of the rare gas and fluorine gas in an arbitrary desired mixing ratio and utilize the mixed gas in the filed of semiconductor manufacture, for example as an excimer laser oscillation gas.

What is claimed is:

1. A fluorine gas generator for generating highly pure fluorine gas by electrolyzing an electrolyte comprising hydrogen fluoride in the form of a molten mixed salt, the generator comprising:

an electrolytic cell divided, by a partition wall, into an anode chamber in which an anode is disposed and a cathode chamber in which a cathode is disposed;

pressure maintenance means for maintaining said anode chamber and said cathode chamber at atmospheric pressure; and liquid level sensing means for sensing the levels of the electrolyte in the anode chamber and in the cathode chamber, respectively, at least five level stages, wherein the liquid level sensing means senses a dangerous liquid level, which is close to an abnormal level, between a highest warning liquid level and an intermediate liquid level and between a lowest warning liquid level and the intermediate liquid level;

the pressure maintenance means includes pressure automatic valves which open/close in association with pressure gauges in the anode chamber and the cathode chamber, the pressure automatic valves discharging or stopping discharge of gases generated in the anode chamber and the cathode chamber, respectively;

a first gas line connected to the cathode chamber for discharging gases inside the cathode chamber, the first gas line having a first automatic valve which opens/closes in association with the liquid level sensing means;

a second gas line connected to the anode chamber for discharging gases inside the anode chamber, the second gas line having a second automatic valve which opens/closes in association with the liquid level sensing means;

a third gas line connected to the cathode chamber for supplying a purge gas, the third gas line having a third automatic valve which opens/closes in association with the liquid level sensing means; and a fourth gas line connected to the anode chamber for supplying a purge gas, the fourth gas line having a fourth automatic valve which opens/closes in association with the liquid level sensing means;

when the liquid level sensing means senses the dangerous level, which is close to the abnormal level, between the intermediate liquid level and the highest warning liquid level, the first automatic valve is automatically closed to stop discharging the gas from the cathode chamber, and the fourth automatic valve is automatically closed to stop supplying the purge gas to the anode chamber; and when the liquid level sensing means senses the highest warning liquid level, the second automatic valve is automatically closed to stop discharging the gas from the anode chamber, and the third automatic valve is automatically closed to stop supplying the purge gas to the cathode chamber.

2. The fluorine gas generator according to Claim 1, wherein the pressure automatic valves, which are one of the constituent elements of the pressure maintenance means for maintaining the electrolytic cell inside pressure at atmospheric pressure, are opened to discharge the electrolytic cell inside gas when the electrolytic cell inside pressure becomes higher than atmospheric pressure.

3. The fluorine gas generator according to claim 1, wherein a compressor and/or a vacuum generator is disposed behind the pressure automatic valves of said pressure maintenance means and are operated in association with pressure gauges of said pressure maintenance means to maintain the pressure automatic valves operated in association with the pressure gauges in a reduced pressure state.

4. The fluorine gas generator according to claim 1, wherein the level sensing means each comprises at least five level sensors configured to sense different liquid levels of the electrolyte.

5. The fluorine gas generator according to claim 1, further comprising pressure gauges to detect the electrolytic cell inside pressures in addition to the level sensing means.

6. The fluorine gas generator according to claim 1 , wherein a rare gas or nitrogen gas is fed to the cathode chamber through the third automatic valve and is fed to the anode chamber through the fourth automatic, which are operated in association with the level sensing means.

7. A fluorine gas generator for generating highly pure fluorine gas by electrolyzing an electrolyte comprising hydrogen fluoride in the form of a molten mixed salt, the generator comprising:

an electrolytic cell divided, by a partition wall, into an anode chamber in which an anode is disposed and a cathode chamber in which a cathode is disposed;

a pressure maintenance unit configured to maintain said anode chamber and said cathode chamber at atmospheric pressure; and a liquid level sensing unit configured to sense the levels of the electrolyte in the anode chamber and in the cathode chamber, respectively, at at least five level stages, wherein the liquid level sensing unit is configured to sense a dangerous liquid level, which is close to an abnormal level, between a highest warning liquid level and an intermediate liquid level, and between a lowest warning liquid level, and the intermediate liquid level;

the pressure maintenance unit includes pressure automatic valves which open/close in association with pressure gauges in the anode chamber and the cathode chamber, the pressure automatic valves discharging or stopping discharge of gases generated in the anode chamber and the cathode chamber, respectively;

a first gas line connected to the cathode chamber for discharging gases inside the cathode chamber, the first gas line having a first automatic valve which opens/closes in association with the liquid level sensing unit;

a second gas line connected to the anode chamber for discharging gases inside the anode chamber, the second gas line having a second automatic valve which opens/closes in association with the liquid level sensing unit;

a third gas line connected to the cathode chamber for supplying a purge gas, the third gas line having a third automatic valve which opens/closes in association with the liquid level sensing unit; and a fourth gas line connected to the anode chamber for supplying a purge gas, the fourth gas line having a fourth automatic valve which opens/closes in association with the liquid level sensing unit;

when the liquid level sensing unit senses the dangerous level, which is close to the abnormal level, between the intermediate liquid level and the highest warning liquid level, the first automatic valve is automatically closed to stop discharging the gas from the cathode chamber, and the fourth automatic valve is automatically closed to stop supplying the purge gas to the anode chamber; and when the liquid level sensing unit senses the highest warning liquid level, the second automatic valve is automatically closed to stop discharging the gas from the anode chamber, and the third automatic valve is automatically closed to stop supplying the purge gas to the cathode chamber.

8. The fluorine gas generator according to Claim 7, wherein the pressure automatic valves, which are one of the constituent elements of the pressure maintenance unit, are opened to discharge a gas inside the electrolytic cell when the pressure of the electrolytic cell becomes higher than atmospheric pressure.

9. The fluorine gas generator according to claim 7, wherein a compressor and/or a vacuum generator is disposed behind the pressure automatic valves of said pressure maintenance unit and are operated in association with pressure gauges of said pressure maintenance unit to maintain the pressure automatic valves operated in association with the pressure gauges in a reduced pressure state.

10. The fluorine gas generator according to claim 7, wherein each sensor of the level sensing unit comprises at least five level sensors configured to sense different liquid levels of the electrolyte.

11. The fluorine gas generator according to claim 7, further comprising pressure gauges to detect a pressure inside the electrolytic cell in addition to the level sensing unit.

12. The fluorine gas generator according to claim 7, wherein a rare gas or nitrogen gas is fed to the cathode chamber through the third automatic valve and is fed to the anode chamber through the fourth automatic valve, which are operated in association with the level sensing unit.

13. A fluorine gas generator, comprising:

an electrolytic cell having an anode chamber in which an anode is disposed and a cathode chamber in which a cathode is disposed;

a pressure maintenance unit configured to maintain said anode chamber and said cathode chamber at atmospheric pressure; and a liquid level sensing unit configured to sense the levels of an electrolyte in the anode chamber and in the cathode chamber, respectively, at at least four level stages, wherein the liquid level sensing unit is configured to sense a dangerous liquid level, which is close to an abnormal level, between a highest warning liquid level and an intermediate liquid level, and between a lowest warning liquid level and the intermediate liquid level;

the pressure maintenance unit includes pressure automatic valves which open/close in association with pressure gauges in the anode chamber and the cathode chamber, the pressure automatic valves discharging or stopping discharge of gases generated in the anode chamber and the cathode chamber, respectively;

a first gas line connected to the cathode chamber for discharging gases inside the cathode chamber, the first gas line having a first automatic valve which opens/closes in association with the liquid level sensing unit;

a second gas line connected to the anode chamber for discharging gases inside the anode chamber, the second gas line having a second automatic valve which opens/closes in association with the liquid level sensing unit;

a third gas line connected to the cathode chamber for supplying a purge gas, the third gas line having a third automatic valve which opens/closes in association with the liquid level sensing unit; and a fourth gas line connected to the anode chamber for supplying a purge gas, the fourth gas line having a fourth automatic valve which opens/closes in association with the liquid level sensing unit;

when the liquid level sensing unit senses the dangerous level, which is close to the abnormal level, between the intermediate liquid level and the highest warning liquid level, the first automatic valve is automatically closed to stop discharging the gas from the cathode chamber, and the fourth automatic valve is automatically closed to stop supplying the purge gas to the anode chamber; and when the liquid level sensing unit senses the highest warning liquid level, the second automatic valve is automatically closed to stop discharging the gas from the anode chamber, and the third automatic valve is automatically closed to stop supplying the purge gas to the cathode chamber.

14. The fluorine gas generator according to claim 13, wherein the pressure automatic valves are opened to ambient to discharge a gas inside the electrolytic cell when the pressure of the electrolytic cell becomes higher than atmospheric pressure.

* * * * *

UNITED STATES PATENT AND TRADEMARK OFFICE

CERTIFICATE OF CORRECTION

PATENT NO. : 8,038,852 B2
APPLICATION NO. : 10/447237
DATED : October 18, 2011
INVENTOR(S) : Tetsuro Tojo et al.

It is certified that error appears in the above-identified patent and that said Letters Patent is hereby corrected as shown below:

Column 8, line 41, change "at least five level stages," to --at at least five level stages,--.

Column 9, line 44, change "the fourth automatic," to --the fourth automatic valve,--.

Signed and Sealed this
Tenth Day of January, 2012

David J. Kappos

David J. Kappos
*Director of the United States Patent and Trademark Office*